US010610908B2

(12) United States Patent
Zanotti

(10) Patent No.: US 10,610,908 B2
(45) Date of Patent: Apr. 7, 2020

(54) DEVICE FOR WASHING CONTAINERS FOR TRANSPORTING LIVE POULTRY

(71) Applicant: Massimo Zanotti, Gussago (IT)

(72) Inventor: Massimo Zanotti, Gussago (IT)

( * ) Notice: Subject to any disclaimer, the term of this patent is extended or adjusted under 35 U.S.C. 154(b) by 0 days.

(21) Appl. No.: 14/610,225

(22) Filed: Jan. 30, 2015

(65) Prior Publication Data

US 2015/0209844 A1 Jul. 30, 2015

(30) Foreign Application Priority Data

Jan. 30, 2014 (IT) ..... TO2014A0070

(51) Int. Cl.

| | |
|---|---|
| ***B08B 9/08*** | (2006.01) |
| ***B08B 9/32*** | (2006.01) |
| ***B08B 9/42*** | (2006.01) |

(52) U.S. Cl.

CPC ..... *B08B 9/0826* (2013.01); *B08B 9/0861* (2013.01); *B08B 9/32* (2013.01); *B08B 9/42* (2013.01)

(58) Field of Classification Search

None

See application file for complete search history.

(56) References Cited

U.S. PATENT DOCUMENTS

| | | | | |
|---|---|---|---|---|
| 4,577,651 A * | 3/1986 | Murtz | B08B 9/0861 134/111 |
| 5,566,697 A * | 10/1996 | Cord | B41F 35/005 134/109 |
| 5,791,385 A * | 8/1998 | Stahlecker | B65B 3/22 141/130 |
| 6,132,509 A | 10/2000 | Kuschnereit | |

FOREIGN PATENT DOCUMENTS

| | | |
|---|---|---|
| DE | 93 06 403 U1 | 8/1993 |
| EP | 2 397 237 A2 | 12/2011 |
| EP | 2902121 B1 | 2/2019 |
| FR | 2 545 012 A1 | 11/1984 |
| FR | 2545012 | 11/1984 |

OTHER PUBLICATIONS

Italian Search Report for IT TO2014000070 dated Aug. 26, 2014.

* cited by examiner

*Primary Examiner* — Eric W Golightly
*Assistant Examiner* — Arlyn I Rivera-Cordero
(74) *Attorney, Agent, or Firm* — Thomas|Horstemeyer, LLP

(57) ABSTRACT

The washing of drawer-like cages for transporting live poultry consists of successively introducing the drawer-like cages into a rotatable drum with a horizontal axis having an inlet and an outlet, driving the continuous rotation of the rotatable drum, providing a helical roto-translational motion to the drawer-like cages from the inlet towards the outlet of the rotatable drum, and spraying the drawer-like cages with a washing liquid during their roto-translational motion.

15 Claims, 6 Drawing Sheets

DEVICE FOR WASHING CONTAINERS FOR TRANSPORTING LIVE POULTRY

CROSS REFERENCE TO RELATED APPLICATIONS

This application claims priority from Italian Patent Application No. TO2014A000070 filed on Jan. 30, 2014, the entire disclosure of which is incorporated herein by reference.

FIELD OF THE INVENTION

The present invention relates in general to containers for transporting live poultry from breeding farms to slaughterhouses, and particularly concerns the cleaning of these containers prior to their return from the slaughterhouse to the breeding farms for successive loading.

STATE OF THE PRIOR ART

Traditionally, for transferring poultry from breeding farms to slaughterhouses, transport units are used on-board trucks, including support frames within which superimposed stacks of drawer-like cages are inserted, in an extractable manner. Examples of such transport units are described and illustrated in documents EP-1330952B1 and WO-2011/010329, and the relative drawer-like cages are typically of the type described and illustrated in document EP-0867113B1. They have a quadrangular shape with a bottom wall and side walls provided with ventilation openings, and an open top for introducing and extracting the poultry.

Normally, these drawer-like cages are continuously moved between the breeding farm and the slaughterhouse, and vice versa, and thus need to be frequently cleaned from organic waste produced by the animals, also and above all in view of the fact that, if a flock is infected with salmonella or campylobacter, the risk of cross-contamination with other breeding farms must be absolutely avoided.

Cleaning of the drawer-like cages must therefore be as effective and complete as possible.

The systems currently in use envisage washing the drawer-like cages arranged in the same position only, typically horizontally with the open side facing upwards or upside-down with the open side facing downwards, or in a vertical position with a comb arrangement. These traditional systems are not able to ensure the required complete cleaning of all the walls of the drawer-like cages with their interstices, and in particular those corresponding to the ventilation openings on the side walls and on the bottom wall. Furthermore, these known systems envisage the movement of the drawer-like cages through the washing station by means of chain-movement assemblies which, in addition to involving cleaning problems themselves, do not allow the drawer-like cages to be kept stably in the most suitable predetermined position for receiving the washing jets.

SUMMARY OF THE INVENTION

The object of the present invention is to overcome the aforesaid drawbacks and to make a device available for washing the drawer-like cages for transporting live poultry, which is able of ensuring the most complete and effective cleaning in a uniform and safe manner.

According to the invention, this object is achieved thanks to a washing device whose unique characteristics are defined in the characterizing part of claim 1, or rather comprising a rotatable drum with a horizontal axis having an inlet and an outlet, between which supports extend parallelly to the axis of the drum, mutually spaced-apart angularly and configured to temporarily engage the drawer-like cages in a slidable manner. Driving means are provided for continuously rotating the rotatable drum, cam means to provide, during rotation of said rotatable drum, a generally helical roto-translational motion to said drawer-like cages engaged with said supports, from said inlet to said outlet, and spraying means of the drawer-like cages with a washing liquid during said roto-translational motion thereof.

The washing liquid may consist of a mixture of sodium hydroxide and water, heated to a temperature of about 90° C., with the object of chemically eliminating organic substances removed from the drawer-like cages and to allow recirculation of the liquid.

Conveniently, the magnitude of the rotatory component of the roto-translational motion of the drawer-like cages is at least 360°, and the supports consist of pairs of shoes configured to engage opposite sides of said drawer-like cages in a slidable manner.

In a preferred embodiment of the invention, the slidable pairs of shoes are four in number and the rotatable drum has a length at least equal to twice the width of one drawer-like cage.

Thanks to this solution idea, the drawer-like cages, sprayed in a plurality of different angular positions over a minimum of 360°, are washed completely and therefore entirely safe against the risk of contamination. The device according to the invention, in addition to being compact and of reduced size, allows the stable and accurate positioning and maintenance of the drawer-like cages in the most suitable positions for obtaining complete and effective washing.

The invention also relates to a method for washing the drawer-like cages for transporting live poultry.

BRIEF DESCRIPTION OF THE DRAWINGS

The invention will now be described in detail with reference to the attached drawings, provided purely by way of non-limiting example, in which.

DETAILED DESCRIPTION OF THE INVENTION

Figure 1:
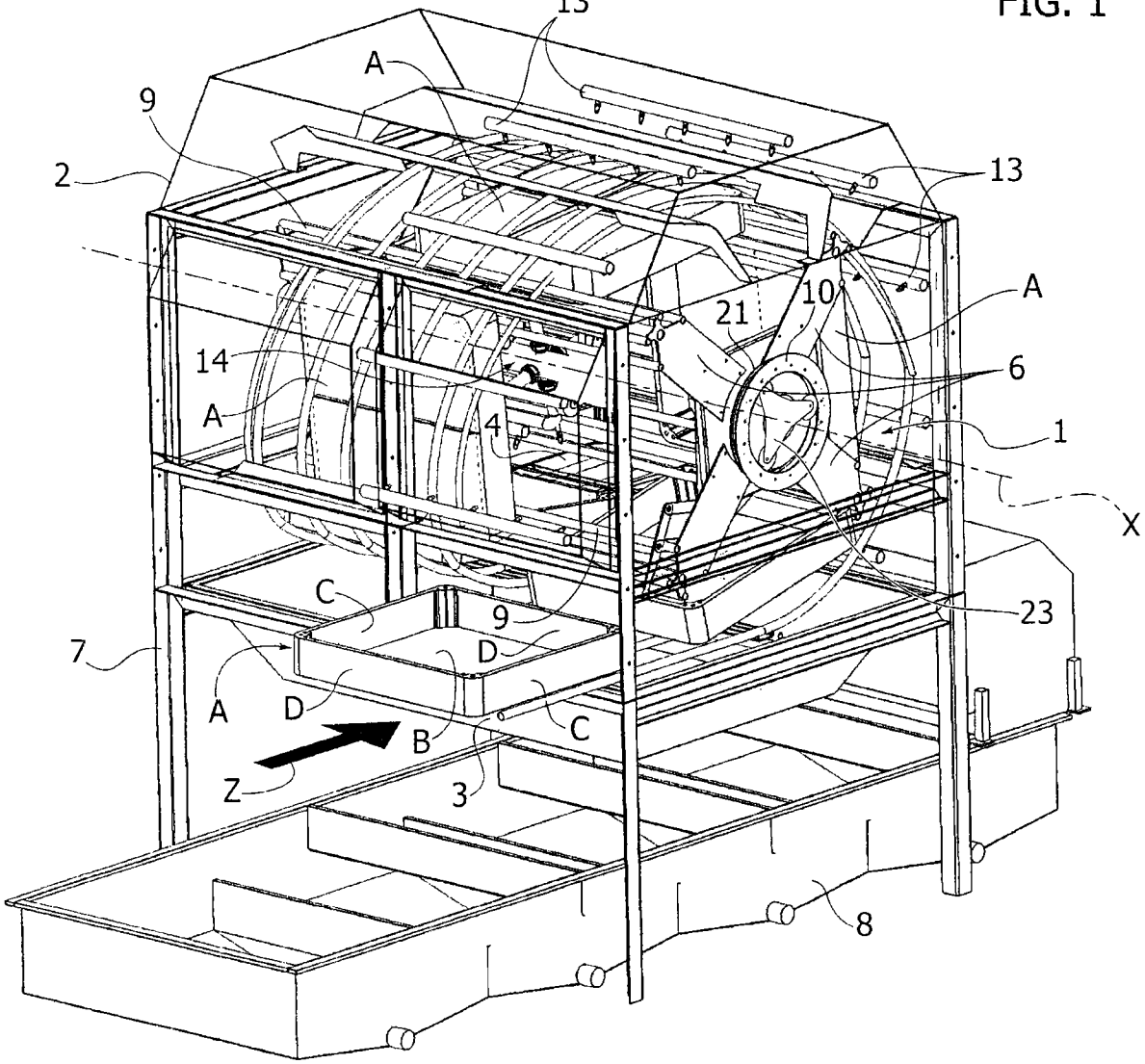
FIG. 1 is a schematic and simplified perspective view of a washing device according to the invention, represented during its operation.

Referring to the drawings, the washing device according to the invention is configured to operate with drawer-like cages for transporting live poultry, indicated by A, for example, of the type described and illustrated in the document cited above, EP-0867113B1. Each drawer-like cage A consists of a body of molded plastic material of a quadrangular shape, more precisely rectangular, open at the top and having a bottom wall B, and two pairs of opposite side walls indicated, respectively, by C and D. Both the bottom wall B and the side walls C, D are normally formed with ventilation openings, not shown for simplicity of illustration.

The washing device of the drawer-like cages A essentially comprises a rotatable hollow drum 1 generally cylindrical, elongated and with a horizontal axis indicated by X, which is contained within a stationary protective casing 2, carried by a supporting frame 7 above a collecting tank 8 of the washing liquid and impurities coming from the drawer-like cages A. This tank 8 is conveniently provided with a grid filter and decantation sectors (not shown) to facilitate the separation of the solid residues from the washing liquid, for example, consisting of a mixture of water and sodium hydroxide, heated to about 90° C., which may be continuously recirculated in this way.

The rotatable drum 1 is driven in rotation in the manner explained below.

The casing 2 is open at the bottom and on one side delimits an inlet 3 and on the opposite side an outlet 4 of the drawer-like cages A relative to the rotatable drum 1. For the reasons which will become apparent below, the inlet 3 and the outlet 4 are mutually offset along the X axis by a magnitude equal to at least twice the width of a drawer-like cage A, measured between its opposite sides C. Therefore, the length of the rotatable drum 1 is also equal to at least twice the width of a drawer-like cage A.

The rotatable drum 1 has four radial arms 6 at each end, angularly equidistant between each other, and corresponding radial arms 6 of the two ends are interconnected axially by respective shoes 9 configured to temporarily engage the opposite sides D of each drawer-like cage A in a slidable manner, introducing them, in turn, through the inlet 3 in the rotatable drum 1.

Figure 3:
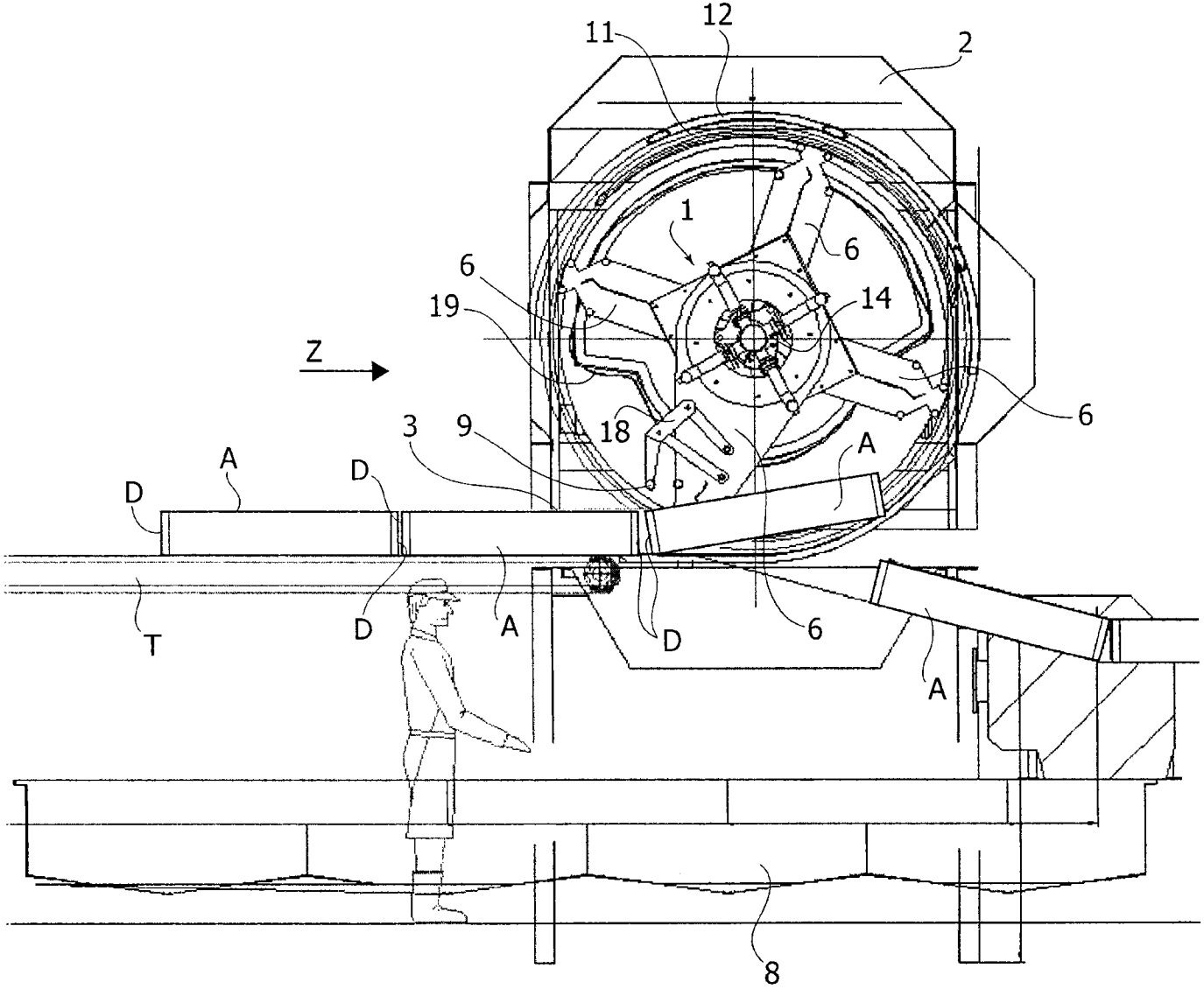
FIG. 3 is a partial view in vertical cross-section of the washing device.

As is illustrated in detail in FIG. 3, the drawer-like cages A are aligned with the inlet 3 along a horizontal row. The support frame 7 should therefore be shaped in a manner suited for this purpose and equipped with appropriate column-guides of the drawer-like cages upstream of the inlet 3 and downstream of the outlet 4.

The drawer-like cages A are continuously fed in the direction of the arrow Z, by means of a motorized conveyor T, to the inlet 3 where they are engaged and introduced into the rotatable drum 1 through a corresponding shoe 9.

Each shoe 9 comprises an articulated-lever kinematic mechanism 18 controlled by a stationary cam 19, configured to close the shoe 9 at the front side D of the drawer-like cage A, present at the inlet 3, drag it within the rotatable drum 1 held in rotation, and then reopen the shoe 9 after about of a rotation, while keeping the side D slidably engaged with the shoe 9. The cam 19 controls the opening of the shoes 9 at the outlet 4, to allow the release and unloading of the drawer-like cages from the rotatable drum 1 at the end of washing.

Figure 4:
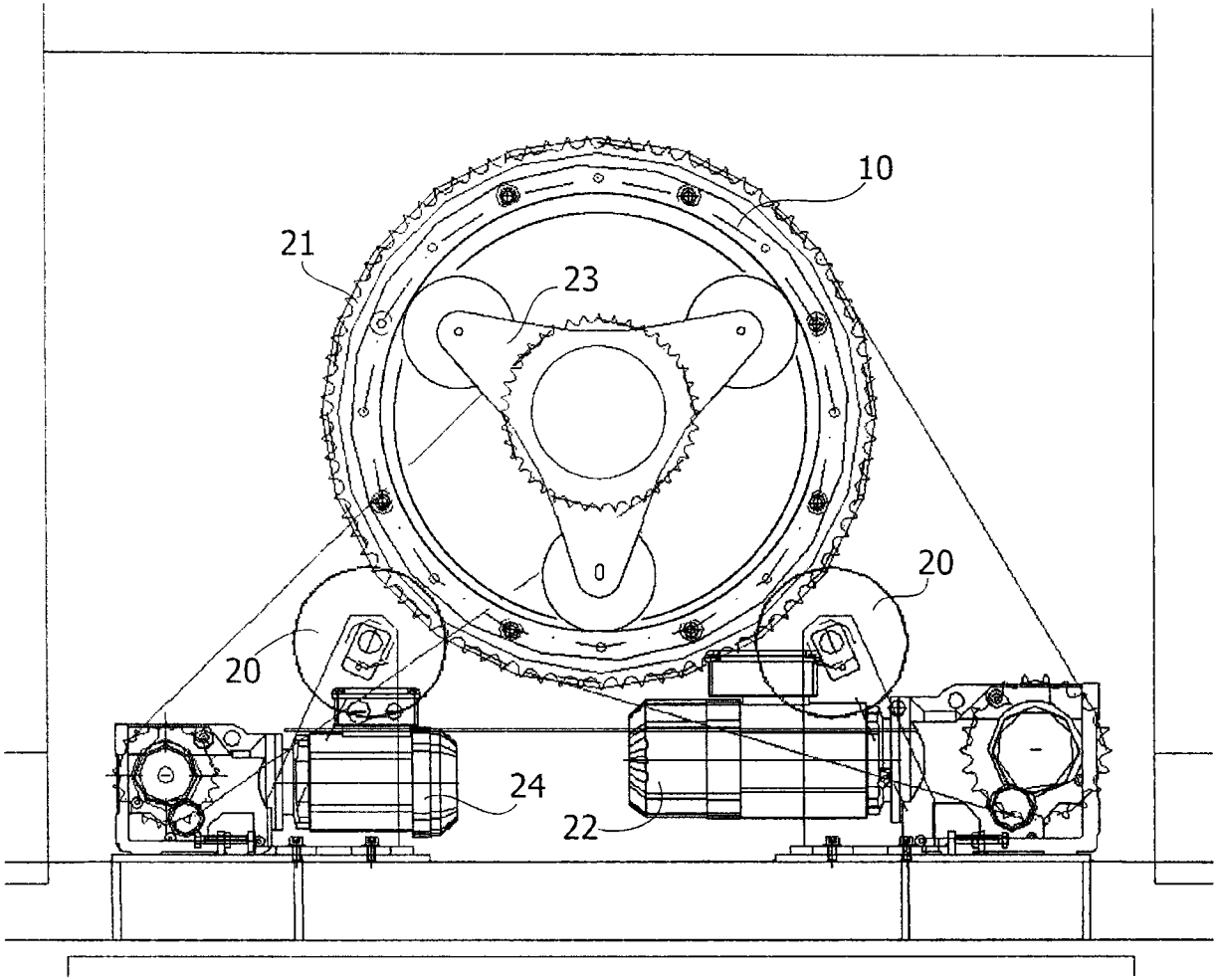
FIG. 4 is a partial side elevation view, on an enlarged scale, of a component of the washing device.
Figure 5:
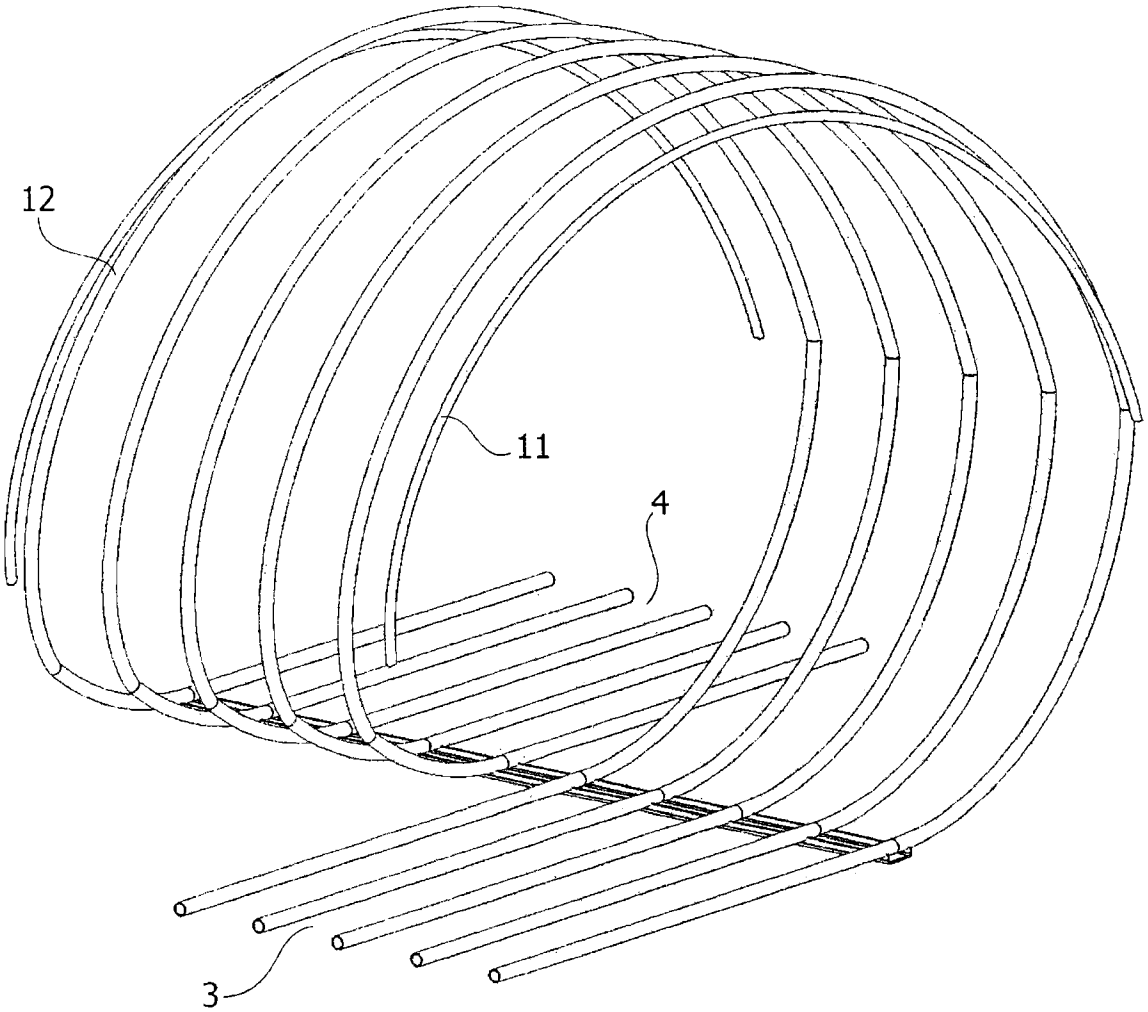
FIG. 5 is a perspective view, on an enlarged scale, of another component of the washing device.

The rotatable drum 1 is also provided at its ends with annular heads 10 supported in a rolling manner on rollers 20 carried by the frame 7, visible in FIG. 4. As is also illustrated in detail in FIG. 4, one of the annular heads 10 carries a gear 21 driven in rotation by a motor 22. During operation, the rotation of the rotatable drum 1 by the motor 22 is continuous, as mentioned, possibly at variable speeds, and in an anticlockwise direction with reference to the drawings.

The device is also configured to provide a generally helical roto-translational motion of said drawer-like cages, introduced, in turn, into the rotatable drum 1 and slidably engaged with the shoes 9, from the inlet 3 to the outlet 4. The magnitude of the rotatory component of the roto-translational motion is at least 360°.

To this effect, a cam member 11 is provided, most clearly seen in FIG. 3, formed by a generally helical stationary element configured to interact with the side of the drawer-like cage A introduced, in turn, into the rotatable drum 1 through the inlet 3. The cam member 11 applies a thrust to the drawer-like cage in a direction parallel to the X axis, causing the drawer-like cage to slide along the relative shoes 9 while it is simultaneously rotated by the rotatable drum 1, thus covering the helical route from the inlet 3 to the outlet 4, pushing the drawer-like cages A already present in the rotatable drum 1 along the same route.

The cam member 11 is fixed to a sliding supporting structure 12 of the drawer-like cages A during their roto-translational motion, which coaxially encloses the rotatable drum 1 from the inlet 3 to the outlet 4.

Figure 2:
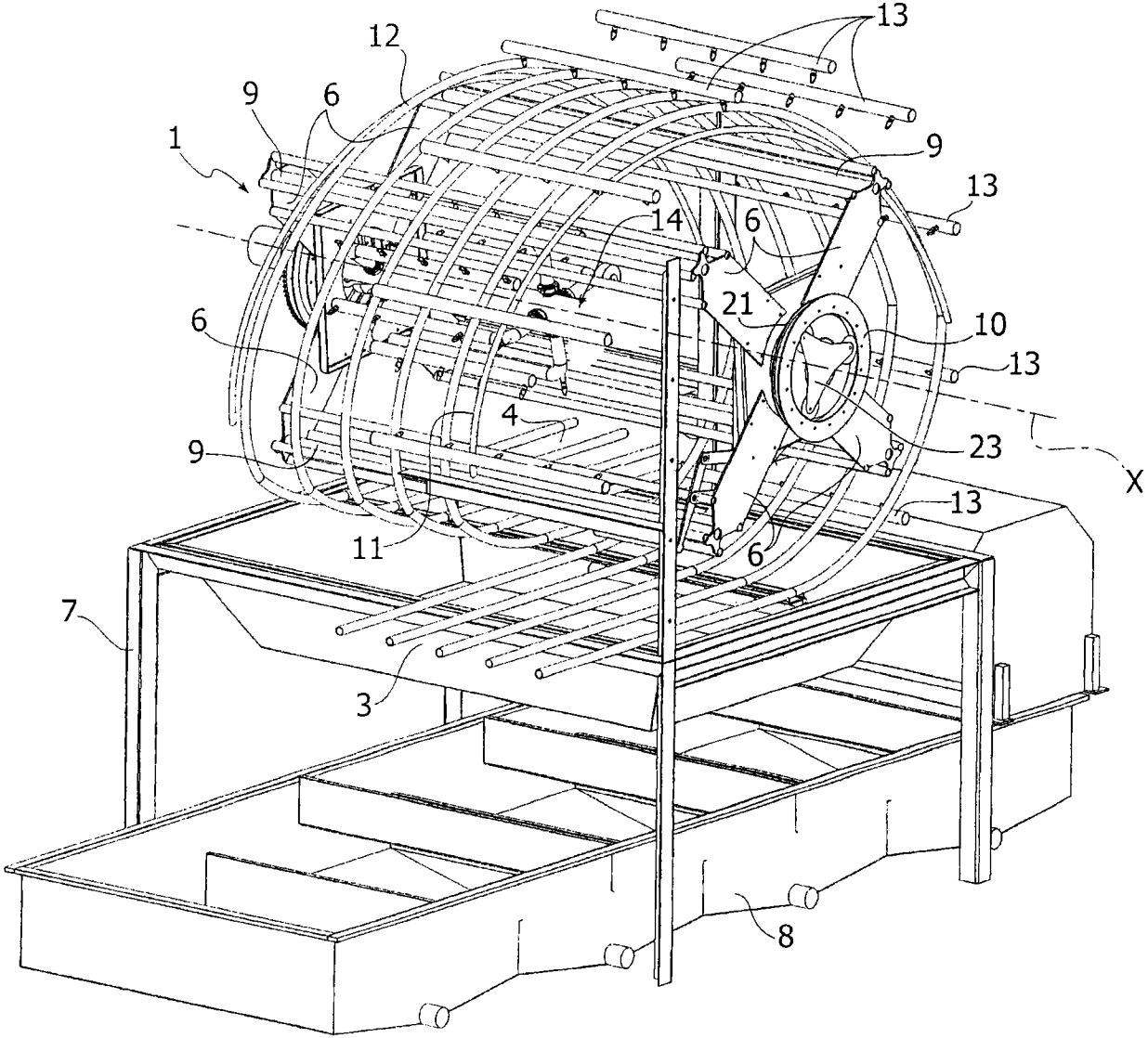
FIG. 2 is a view analogous to FIG. 1, in which some parts are omitted to highlight the operating components of the washing device.

For washing the drawer-like cages A during their roto-translational motion in the rotatable drum 1, a plurality of stationary tubes 13 are provided, arranged outside the rotatable drum 1 and bearing sprinkling nozzles, and an assembly of rotatable sprayers 14, arranged coaxially within the rotatable drum 1. Although in FIGS. 1 and 2 the spraying assembly 14 is only represented in part, for simplicity of illustration, it extends for the entire length of the rotatable drum 1.

Figure 6:
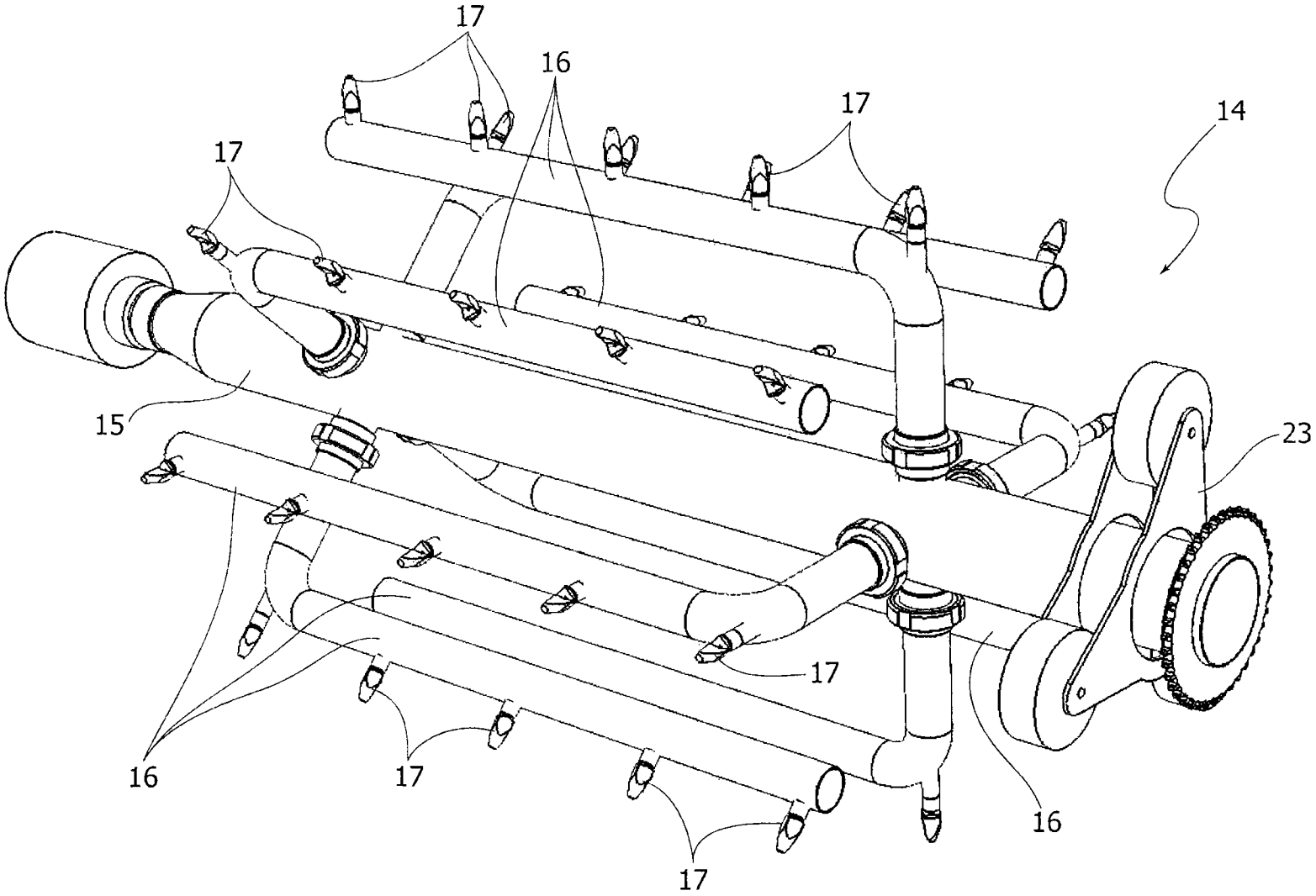
FIG. 6 is a perspective view of a further component of the washing device.

As is illustrated in detail in FIGS. 4 and 6, the spraying assembly 14 is formed of a central manifold 15, rotatably supported within at least one of the annular heads 10 of the rotatable drum 1 through a roller assembly 23, and driven in rotation by means of a motor 24. The central manifold 15 is connected to a plurality of tubes 16, which extend axially within the drum 1 and are provided with sprinkling nozzles 17.

The operating cycle involves, during the continuous rotation of the rotatable drum 1, advancing of the row of drawer-like cages A towards the inlet 3. The front wall D of the drawer-like cages A, which arrive one-by-one, is engaged by one of the shoes 9, dragged onto the supporting structure 12 and then connected at the rear wall D by the successive shoe 9. In this way, the drawer-like cage A starts to rotate with the rotatable drum 1, resting in a slidable manner on the structure 12, while it is simultaneously pushed laterally by the cam element 11, sliding along the two shoes 9 partially opened by the cam 19 and pushing the drawer-like cages A previously introduced into the rotatable drum 1. Each drawer-like cage A thus covers the 360° helical route up to the outlet 4 while it is sprayed by the washing liquid, from the outside by means of the tubes 13 and from inside by means of the assembly 14. The drawer-like cages A, in turn positioned at the lower area of the rotatable drum 1, also receive the falling washing liquid sprayed on the drawer-like cages A above.

It is apparent from the above description that the washing device according to the invention ensures complete and effective cleaning of the drawer-like cages, at the same time having a compact structural configuration, with a reduced size, as well as being more efficient from a functional point of view.

Of course, the details of construction and the embodiments may be varied widely with respect to those described and illustrated, without departing from the scope of the present invention as defined by the following claims. Thus, for example, the rotatable drum 1 may have a multiple length of the width of the drawer-like cages A, in such a way so that the cages, during their movement from the inlet 3 to the outlet 4, may complete more than one full rotation, and the shoes 9 can be of a greater or lesser number than four. Furthermore, prior to the inlet 3 of the rotatable drum 1, a high-pressure pre-washing assembly (not shown) of the drawer-like cages A may be provided.

The invention claimed is:

1. A method for washing containers for transporting live poultry consisting of drawer-like cages having a quadrangular shape using a rotatable drum, the method comprising:

successively introducing said drawer-like cages into the rotatable drum, the rotatable drum having a horizontal axis, an inlet, an outlet, and supports extending parallel to said axis of the drum, said supports mutually spaced-apart angularly and configured to temporarily engage the drawer-like cages in a slidable manner, the supports consisting of pairs of shoes configured to slidably engage two opposite side walls of said drawer-like cages, wherein the rotatable drum further comprises a stationary cam, and said shoes are provided with opening and closing kinematic mechanisms operated by said stationary cam during rotation of the rotatable drum;

wherein introducing the drawer-like cages into said rotatable drum is carried out upon engagement thereof by said shoes configured to slidably engage two opposite side walls of said drawer-like cages, rotating said rotatable drum, moving said drawer-like cages according to a helical roto-translational motion from the inlet to the outlet of the rotatable drum while rotating said rotatable drum, and spraying said drawer-like cages with a washing liquid during the helical roto-translational motion thereof.

2. The method according to claim 1, wherein the magnitude of the rotatable component of the roto-translational motion of the drawer-like cages is at least 360°.

3. The method according to claim 1 wherein the introducing the drawer-like cages into the rotatable drum is carried out during advancing of said drawer-like cages aligned along a horizontal row at the inlet of the drum.

4. The method according to claim 1 wherein the drawer-like cages are sprayed both externally and internally with the washing liquid.

5. The method according to claim 1 wherein the washing liquid is a heated mixture of sodium hydroxide and water.

6. A device for washing containers for transporting live poultry, wherein said containers consist of drawer-like cages having a quadrangular shape with a bottom wall, side walls and an open top, the device comprising:

a drum rotatable around a horizontal axis and having an inlet and an outlet between which supports extend parallel to said axis of the drum, said supports mutually spaced-apart angularly and configured to temporarily engage the drawer-like cages in a slidable manner, driving means for continuously rotating said rotatable drum, cam means configured to provide, during rotation of said rotatable drum, a helical roto-translational motion of said drawer-like cages, engaged with said supports from said inlet to said outlet, spraying means of the drawer like cages with a washing liquid during said roto-translational motion thereof, wherein said supports consist of pairs of shoes configured to slidably engage two opposite side walls of said drawer-like cages, wherein the device further comprises a stationary cam, and said shoes are provided with opening and closing kinematic mechanisms operated by said stationary cam such that introducing the drawer-like cages into said rotatable drum is carried out upon engagement thereof by said shoes, which are provided with opening and closing kinematic mechanisms, operated by said stationary cam during said rotation of the rotatable drum.

7. The device according to claim 6, wherein a magnitude of the rotatable component of the roto-translational motion of the drawer-like cages is at least 360°.

8. The device according to claim 6, wherein said pairs of shoes are four in number.

9. The device according to claim 6 wherein said rotatable drum has a length at least equal to twice the width of one drawer-like cage.

10. The device according to claim 6 wherein said cam means include a generally helical stationary element designed to interact with said drawer-like cages by applying a thrust in a direction parallel to the axis of the rotatable drum.

11. The device according to claim 6 wherein said rotatable drum is arranged within a stationary structure providing sliding bearing of said drawer-like cages during the roto-translational motion thereof.

12. The device according to claim 6 wherein said spraying means are arranged externally to said rotatable drum.

13. The device according to claim 12, wherein said spraying means are located internally to said rotatable drum.

14. The device according to claim 13, wherein said spraying means comprise a rotatable assembly formed of a central manifold connected to a number of tubes extending axially within the rotatable drum and provided with sprinkling nozzles.

15. The device according to claim 6 wherein a collecting tank for the washing liquid and for the material removed from the drawer-like cages is arranged beneath said rotatable drum and is provided with a filter and decantation sectors in order to enable re-circulation of the washing liquid towards said spraying means.

* * * * *